United States Patent [19]

Bourque

[11] Patent Number: 4,965,935

[45] Date of Patent: Oct. 30, 1990

[54] TILE CUTTING TABLE

[76] Inventor: Roger Z. Bourque, P.O. Box 6, Scoudouc EOA,1ND, Canada

[21] Appl. No.: 362,008

[22] Filed: Jun. 5, 1989

[51] Int. Cl.[5] ..... B24H 1/04; B28D 1/22

[52] U.S. Cl. ..... 33/26

[58] Field of Search ..... 33/26, 32.1, 32.2, DIG. 20, 33/32.3, 526, 527, 430, 433

[56] References Cited

U.S. PATENT DOCUMENTS

| | | | |
|---|---|---|---|
| 1,569,090 | 6/1924 | Johnson | 33/430 |
| 2,006,183 | 6/1935 | Schafer | 33/430 |
| 2,034,177 | 3/1936 | Flatt | 33/32.3 |
| 2,089,757 | 8/1937 | Nieuwkamp | 33/437 |
| 4,084,569 | 4/1978 | Chrismas | 33/32.2 |

FOREIGN PATENT DOCUMENTS

| | | | |
|---|---|---|---|
| 11791 | 2/1928 | Australia | 33/430 |

*Primary Examiner*—William A. Cuchlinski, Jr.
*Assistant Examiner*—William C. Dowling
*Attorney, Agent, or Firm*—Leon Gilden

[57] ABSTRACT

A tile cutting table is set forth wherein a support table includes a rear integrally formed abutment ledge provided with side end portions extending outwardly beyond the sides of the table for providing extended support of rigid tile members supported on an upper surface of the table. The cutting and measuring rule is pivotally mounted to a stationary member fixedly secured to an upper surface of the abutment edge by a plurality of hinges with a rod slidably mounted within the hinges. The rule includes a longitudinal and medially aligned slot for receiving a cutting tool therein, wherein the slot is of a width substantially equal to the width of the blade of the cutting tool. The rule may be angularly oriented and repositionable within an arcuate slot to re-orient the rule from five degrees to ninety degrees relative to the support table and abutment ledge. The abutment ledge is spaced above the support surface to accommodate a tile between the rule and the support surface. The stationary portion of the rule is further provided with a magnetized bottom surface to enable convenient storage of the apparatus when not in use for securement of the rule assembly to the support surface of the support table.

7 Claims, 4 Drawing Sheets

TILE CUTTING TABLE

BACKGROUND OF THE INVENTION

1. Field of the Invention

The field of invention relates to cutting tables, and more particularly pertains to a new and improved tile cutting table wherein the same enables convenient angular measurement and cutting of tiles, as used in the construction trade.

2. Description of the Prior Art

The use of cutting tables is well known in the prior art. The prior art, however, has heretofore failed to provide a complete organization to effect accurate and precise cutting of an underlying workpiece, as set forth by the instant invention. For example, U.S. Pat. No. 3,292,263 to Barry sets forth a scribe tool utilizing a "T" square to overlie a workpiece with a slot therewithin to enable a scribing device to be directed through the slot to effect desired marking of an underlying workpiece.

U.S. Pat. No. 4,553,327 to Watanabe sets forth a ruler organization wherein a fixed rail laterally of a work table slidingly supports a carriage that may be shifted overlying a workpiece provided with a scriber to indicate a desired marking on an underlying workpiece.

U.S. Pat. No. 3,611,579 to Raid sets forth a floor tile marking gauge wherein the gauge includes an adjustable template and guide for cutting parallel and perpendicular to marginal side edges of a tile.

U.S Pat. No. 2,580,268 to Woten sets forth a slotted rule provided with spaced clamps with a scribing or indicating marker to be directed along the slot for indicating a desired cutting of an underlying brick.

U.S. Pat. No. 4,084,569 to Chrismas sets forth a tile cutter for scoring of a &tile wherein the marker is arranged for orthogonal orientation relative to a base to provide for orthogonal scoring of underlying tiles.

As such, it may be appreciated that there is a continuing need for a new and improved tile cutting table wherein the same allows for the angular orientation of a cutting template overlying a tile to be cut, wherein the template may be oriented at desired angular relations to the underlying tile.

SUMMARY OF THE INVENTION

In view of the foregoing disadvantages inherent in the known types of tile cutting table is now present in the prior art, the present invention provides a tile cutting table wherein the same provides for angulated cutting of underlying tile workpieces and further enables compact storage of the device during periods of non-use. As such, the general purpose of the present invention, which will be described subsequently in greater detail, is to provide a new and improved tile cutting table which has all the advantages of the prior art tile cutting tables and none of the disadvantages.

To attain this, the present invention includes a tile cutting table utilizing a support table with an upper support surface including an abutment ledge integrally secured along and coextensively with an edge of the support surface wherein the abutment edge extends exteriorly of the side edges of the support surface for expanded support of tiles to be positioned thereagainst. A gauge assembly includes a quarter circular base portion hingedly mounted to the abutment surface at a rear edge wherein the gauge assembly includes a pivot with a clamp member positionable along a groove to enable a guide rule to be angulated in degrees from five to ninety relative to the support surface and abutment ledge. The abutment ledge includes three hinge portions that are selectively cooperative with two hinge portions of the gauge assembly to be pivotally assembled to the abutment ledge to accommodate repositioning of the base portion relative to an underlying tile to be cut. The base portion further includes a magnetized base laminate whereupon removal of the base portion relative to the abutment ledge, the base portion may subsequently be magnetically secured to an upper surface of the support table for storage.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tile cutting table which has all the advantages of the prior art tile cutting tables and none of the disadvantages.

It is another object of the present invention to provide a new and improved tile cutting table which may be easily and efficiently manufactured and marketed.

It is a further object of the present invention to provide a new and improved tile cutting table which is of a durable and reliable construction.

An even further object of the present invention is to provide a new and improved tile cutting table which is susceptible of a low cost of manufacture with regard to both materials and labor, and which accordingly is then susceptible of low prices of sale to the consuming public, thereby making such tile cutting tables economically available to the buying public.

Still yet another object of the present invention is to provide a new and improved tile cutting table which provides in the apparatuses and methods of the prior art some of the advantages thereof, while simultaneously overcoming some of the disadvantages normally associated therewith.

Still another object of the present invention is to provide a new and improved tile cutting table wherein the same may be angularly oriented overlying a tile workpiece to be cut and may be further arranged to enable separation of a gauge assembly relative to the cutting table for storage of the apparatus during periods of non-use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
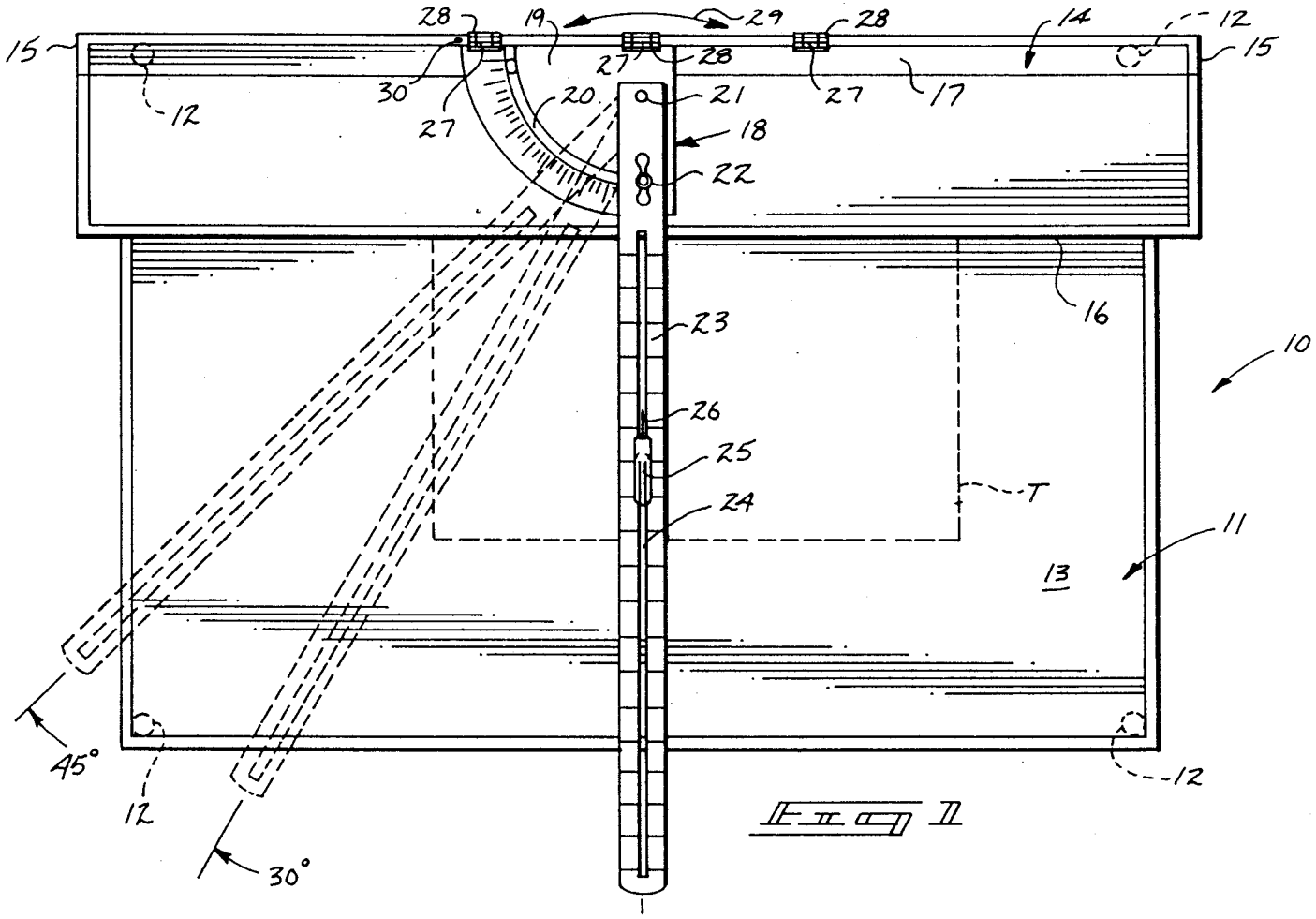
FIG. 1 is a top orthographic view of the instant invention.
Figure 2:
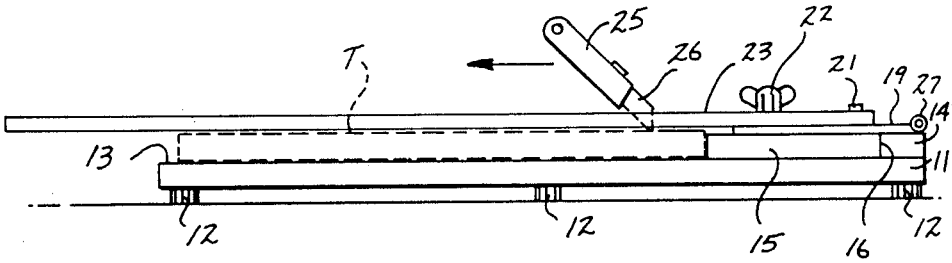
FIG. 2 is an orthographic side view of the instant invention, taken in elevation.

With reference now to the drawings, and in particular to FIGS. 1 to 5 thereof, a new and improved tile cutting table embodying the principles and concepts of the present invention and generally designated by the reference numeral 10 will be described.

More specifically, the tile cutting table 10 of the instant invention essentially comprises a support table 11 formed with resilient friction feet 12 oriented at the corners and intermediate thereof for secured support of the support table. The table 11 further includes an upper support surface 13 with an abutment ledge 14 integrally and fixedly secured coextensively along a rear side edge of the support table 11 on the upper support surface 13 wherein end portions of the abutment ledge 14 extend exteriorly and beyond end surfaces of the support table 11 to provide for expanded abutment support along an abutment surface 16 extending orthogonally upwardly of the top support surface 13 and support table 11. The abutment ledge includes a top surface 17 wherein a gauge assembly 18 is selectively secured thereto. The gauge assembly 18 includes a quarter circular base 19 with a quarter circular arcuate groove 20 formed orthogonally through the base 19. A pivot 21 extending orthogonally outwardly of base 19 secures a guide rule 23 pivotally relative to an upper surface of the base 19. A positioning clamp 22 including a wing nut and integrally threaded boss **22*a* extends through the groove 20 and orthogonally through the guide rule 28 spaced from the pivot 21 to enable pivotment of an aperture of the guide rule 23 within the groove 20 and through-extending the base 19. The wing nut associated with the positioning clamp 22 may be tightened to secure the rule 23 relative to the base 19**.

The guide rule 28 includes a cutting slot 24 extending beyond the base 19 proximate a forward terminal of the guide rule 23. The cutting slot 24 is through-extending the guide rule 23 and accommodates a cutting tool 25 therein with a cutting blade 26 of a width substantially equal to that& of the cutting slot 24 to provide a secure and precise cutting and underlying tile "T" The base 19 includes a plurality of spaced hinge portions 25 cooperative with a plurality of abutment hinge portions 28. There is a third hinge portion 28 spaced a distance equal to the spacing of the two base hinge portions 27 to enable the base 19 and gauge assembly 18 to be rotated one hundred eighty degrees in the direction of arrow 19 to enable the gauge assembly 18 to complete a one hundred eighty degree arc, if desired, for cutting of an underlying tile "T" to enable displacement of the rule 23, as desired, angularly over the top support surface 13 of the support table 11. To further accommodate this repositioning of the gauge assembly 18, the washer and threaded boss 22 may be removed and also redirected through the rule 23 to position the wing nut on the reverse side of the base 19 upon rotating of the base 19 in the direction of the arrow 19.

Figure 3:
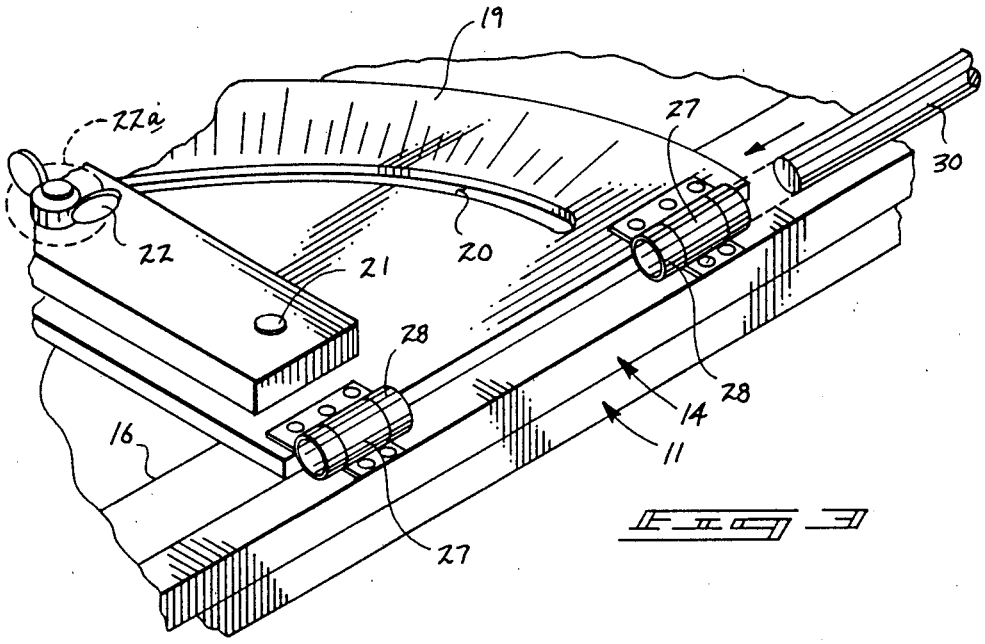
FIG. 3 is an isometric fragmentary view of the gauge assembly secured to the associated abutment ledge.
Figure 4:
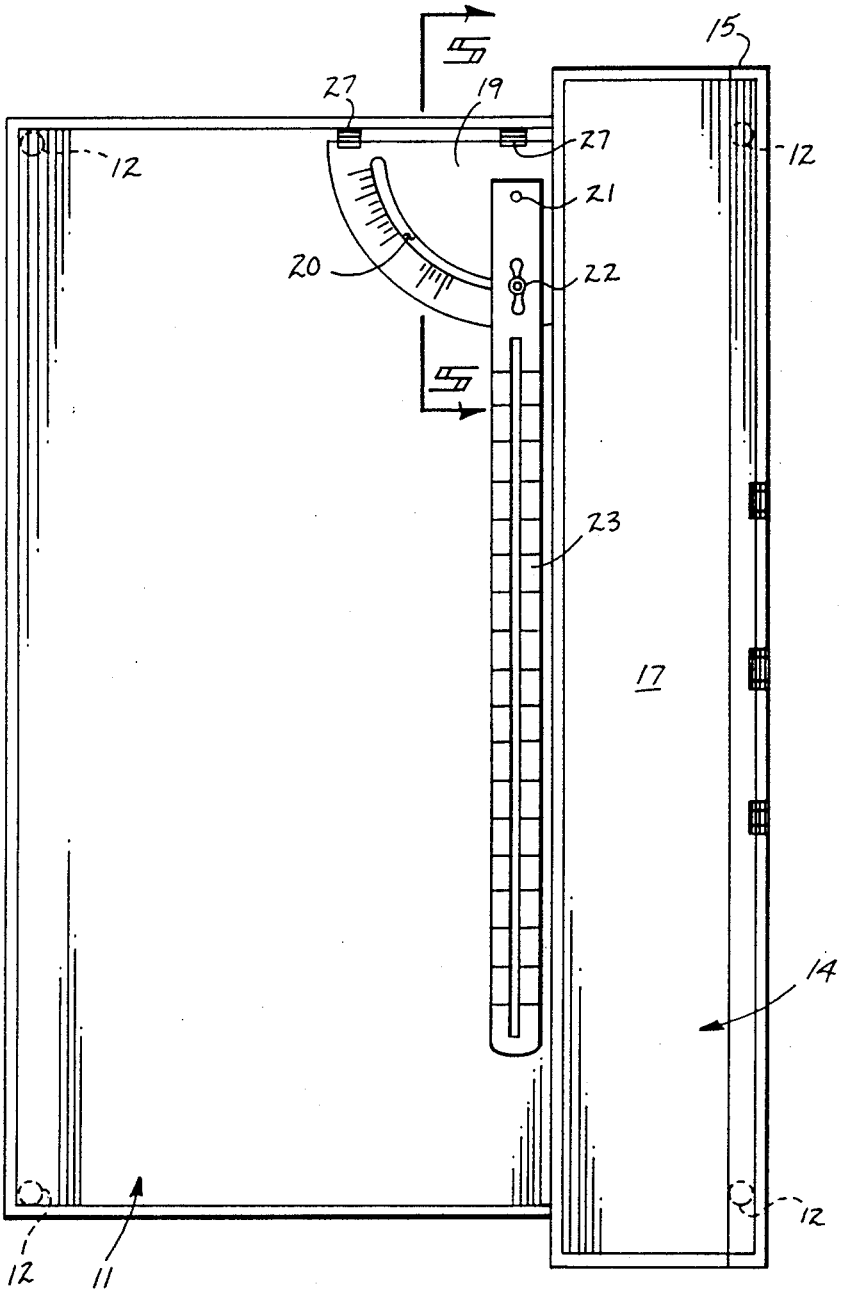
FIG. 4 is a top orthographic view of the instant invention illustrating the storage of the gauge assembly relative to the support table.
Figure 5:
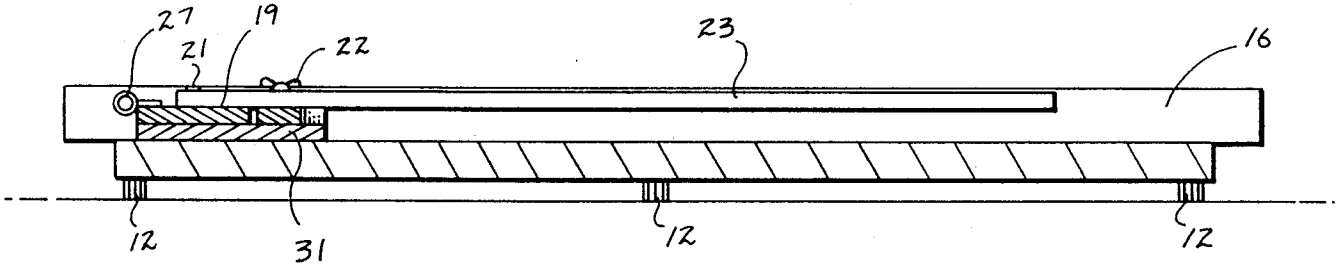
FIG. 5 is an orthographic view taken along the lines 5—5 of FIG. 4 in the direction indicated by the arrows.

The base 19 is further provided with a magnetic bottom surface whereupon removal of the pivot rod, as illustrated in FIG. 3, the gauge assembly 18 may be positioned and magnetically stored upon the support surface 13, typicall formed of a porous metallic surface. Inasmuch as the base 19 and the overlying guide rule 23 are of equal thickness to the height abutment surface 16 of the abutment ledge 14, compact storage and securement of the top table 10 during periods of non-use may be thusly effected.

It is understood that the guide rule 23 may be angularly oriented along the positioning groove 20 in increments of five to ninety degrees relative to the abutment ledge 14 wherein the rule 23 and the positioning groove 20 are provided with incremental measuring indicia to enable a precise indication of the orientation of the rule 23 relative to the positioning groove 20 and of the tile "T" and is positioning underlying the rule 23.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A tile cutting table comprising, a support table including a planar top surface, an elongate rear edge spaced from a forward edge, and side edges to define the top surface, and an abutment ledge integrally secured to and coextensively with said rear edge wherein said abutment ledge extends above the top surface defining an abutment surface oriented orthogonally to said top surface and spaced between the rear and forward edges, and a gauge assembly including a base portion pivotally mounted onto an abutment ledge top surface spaced above the planar top surface including a plurality of first hinge segments secured to said base portion cooperative with a plurality of second hinge segments secured to a rear top edge of said abutment ledge, and a guide rule pivotally mounted to said base portion, and wherein the abutment ledge extends beyond each side edge of the support table, and wherein a further second hinge segment is secured aligned with the plurality of second hinge segments to the rear top edge of said abutment ledge, and further including a cylindrical rod defining a length equal to a distance between the plurality of second hinge segments to selectively secure the base portion to the plurality of second hinge segments or selectively to one of said plurality of hinge segments and to the further second hinge segment upon rotation of the base portion one hundred eighty degrees relative to the rear top edge of said abutment ledge.

2. A tile cutting table as set forth in claim 1 wherein the guide rule includes an elongate through-extending cutting slot formed through the guide rule and extending from a first position beyond the base portion to a second position spaced from a forward terminal end of the guide rule.

3. A tile cutting table as set forth in claim 2 further including a cutting tool including a forwardly extending cutting blade of a predetermined width, and the cutting slot is of a width equal to the predetermined width of the cutting blade.

4. A tile cutting table as set forth in claim 3 wherein the base portion is defined by a quarter circular segment including a positioning groove formed within the quarter circular segment and receiving a clamping member extending through the positioning groove and through the guide rule to selectively clamp the guide rule relative to the base portion.

5. A tile cutting table as set forth in claim 4 wherein the guide rule is pivotally mounted to the base portion with a pivot pin extending orthogonally through the guide rule and through the base portion and spaced between the clamp member and a rear edge of the base portion.

6. A tile cutting table as set forth in claim 5 wherein the base portion includes a magnetic bottom surface to magnetically secure the gauge assembly to the top surface upon removal of the pivot rod from the plurality of first hinge segments and the plurality of second hinge segments to enable repositioning of the gauge assembly onto the top surface of the support table.

7. A tile cutting table as set forth in claim 6 wherein the base portion and the guide rule define a predetermined height, and the predetermined height is equal to a height defined by the abutment surface.

* * * * *